US007222591B1

(12) United States Patent
Peart et al.

(10) Patent No.: US 7,222,591 B1
(45) Date of Patent: May 29, 2007

(54) DUCTED SECONDARY AIR FUEL-FIRED WATER HEATER LDO DETECTION

(75) Inventors: Jacob A. Peart, Wetumpka, AL (US); Hector J. Donastorg, Auburn, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 11/374,356

(22) Filed: Mar. 13, 2006

(51) Int. Cl.
*F24H 9/20* (2006.01)

(52) U.S. Cl. ..... 122/14.31; 122/14.2

(58) Field of Classification Search ..... 122/14.31, 122/14.2, 14.1; 126/350.1, 351.1, 360.1
See application file for complete search history.

(56) References Cited

U.S. PATENT DOCUMENTS

| | | | | |
|---|---|---|---|---|
| 5,004,487 | A | 4/1991 | Kowalczyk | |
| 5,014,338 | A | 5/1991 | Glucksman | |
| 5,097,606 | A | 3/1992 | Harmelink et al. | |
| 5,111,529 | A | 5/1992 | Glucksman | |
| 5,192,346 | A | 3/1993 | Kowalczyk | |
| 5,448,677 | A | 9/1995 | Fell et al. | |
| 6,216,643 | B1 * | 4/2001 | Reynolds et al. | 122/13.01 |
| 6,497,200 | B2 | 12/2002 | Stretch et al. | |
| 6,715,451 | B2 | 4/2004 | Stretch et al. | |
| 6,776,125 | B2 | 8/2004 | Stretch et al. | |
| 6,779,279 | B2 | 8/2004 | Lee et al. | |
| 6,814,031 | B2 | 11/2004 | Stretch et al. | |
| 6,893,253 | B2 | 5/2005 | Stretch et al. | |
| 7,162,980 | B2 * | 1/2007 | Peart | 122/14.31 |
| 2006/0118063 | A1 * | 6/2006 | Shellenberger et al. | 122/14.2 |

FOREIGN PATENT DOCUMENTS

| | | |
|---|---|---|
| JP | 57147035 | 9/1982 |
| JP | 62200133 | 9/1987 |
| JP | 7328291 | 12/1995 |

* cited by examiner

*Primary Examiner*—Gregory Wilson
(74) *Attorney, Agent, or Firm*—Haynes and Boone, LLP

(57) ABSTRACT

A radiant burner within the combustion chamber of a fuel-fired water heater is supplied with primary and secondary combustion air from outside the combustion chamber. A flame-holding mesh section of the burner is protected from becoming unacceptably clogged by particulate matter in the primary combustion air by causing the incoming secondary combustion air to flow sequentially through a finer mesh section and a tapered duct which increases the velocity of the secondary combustion air before causing it to impinge upon and cool a temperature sensor connected to a controller. Clogging of the finer mesh section decreases the cooling of the temperature sensor, thereby causing the controller to terminate operation of the burner before it becomes unacceptably clogged.

20 Claims, 1 Drawing Sheet

DUCTED SECONDARY AIR FUEL-FIRED WATER HEATER LDO DETECTION

BACKGROUND OF THE INVENTION

The present invention generally relates to fuel-fired heating apparatus and, in a representatively illustrated embodiment thereof, more particularly provides a fuel-fired water heater having incorporated therein a burner clogging detection and shutdown system.

Fuel-fired water heaters typically operate in locations (such as, for example, attics, closets, basements, sheds, etc.) which are not regularly cleaned, and have ambient air containing particulate matter such as lint, dirt and/or oil (commonly referred to as "LDO"). It is this contaminant-laden air which is delivered to the water heater as combustion air for its burner system. The airborne particulate matter in such combustion air can, over time, clog the water heater's burner and undesirably increase its production of carbon monoxide.

In view of this it would be desirable to provide a fuel-fired water heater with a burner clogging detection system which could monitor the degree of burner clogging caused by airborne particulate matter ingested by the burner and prevent further burner combustion in response to the detection of a predetermined level of burner clogging. It is to this goal that the present invention is primarily directed.

SUMMARY OF THE INVENTION

In carrying out principles of the present invention, in accordance with a preferred embodiment thereof, a specially designed fuel-fired heating apparatus, representatively a gas-fired water heater, is provided. The water heater comprises a tank for storing water to be heated, and a combustion chamber in thermal communication with the tank. A fuel burner, representatively a radiant burner, is operative to create hot combustion products within the combustion chamber, the fuel burner being progressively cloggable by particulate matter (such as lint, dirt and/or oil) entrained in primary combustion air being delivered thereto during firing of the burner.

A first air supply structure is provided for supplying primary combustion air to the fuel burner from outside of the combustion chamber without exposing the supplied primary combustion air to the is interior of the combustion chamber on its way to the fuel burner. Additionally, a second air supply structure is provided for receiving secondary combustion air from outside the combustion chamber and discharging the received secondary combustion air into the interior of the combustion chamber, at a discharge velocity, for flow therethrough to the fuel burner, the second air supply structure being progressively cloggable at a greater rate than the fuel burner, by particulate matter entrained in the received secondary combustion air in a manner progressively reducing the discharge velocity of the secondary combustion air.

According to a key aspect of the present invention, a system is provided for monitoring the secondary combustion air discharge velocity within the combustion chamber and responsively terminating operation of the fuel burner when the discharge velocity decreases to a predetermined magnitude indicative of a predetermined degree of clogging of the second air supply structure. Preferably, such system includes a temperature sensor, representatively a thermal release device (TRD), disposed within the interior of the combustion chamber and positioned to be impinged by secondary combustion air being discharged into the combustion chamber from the second air supply structure. The system is operative to monitor the temperature of the temperature sensor (thus also indirectly monitoring the secondary combustion air discharge velocity) and responsively terminate the operation of the fuel burner when the temperature reaches a predetermined magnitude indicative of a predetermined reduction in the cooling of the temperature sensor caused by a reduction in the secondary combustion air discharge velocity.

Preferably, the fuel burner is disposed within the combustion chamber, and the first air supply structure includes a primary combustion air supply duct extending through the combustion chamber, from a location exterior thereto, and operatively connected to the fuel burner.

The second air supply structure preferably includes a cloggable perforate structure disposed on an outer wall of the combustion chamber, and further includes a duct disposed in said combustion chamber and having an open inlet end connected to the cloggable perforate structure, and an open outlet end through which secondary combustion air may be discharged into the combustion chamber at the aforementioned discharge velocity.

According to an aspect of the invention, the open outlet end of the secondary combustion air supply duct has a smaller cross-sectional area than its open inlet end, whereby the secondary combustion air discharge velocity is greater than the velocity of the secondary combustion air across the cloggable perforate structure disposed on the outer wall of the combustion chamber.

In an illustrated preferred embodiment thereof, the fuel-fired water heater further comprises a fuel supply system including a fuel supply pipe connected to the fuel burner and having a fuel valve connected therein. The temperature sensor is operative to output a control signal indicative of the temperature of the temperature sensor increasing to a predetermined elevated temperature and being useable to terminate burner combustion by, for example, shutting off further combustion air or fuel flow to the system.

Preferably, the radiant burner has a cloggable flame-holding metal mesh wall section, and the cloggable perforate structure disposed on an outer wall of the combustion chamber is a metal mesh structure of a finer mesh size than the cloggable flame-holding metal mesh wall section of the radiant burner.

Figure 1:
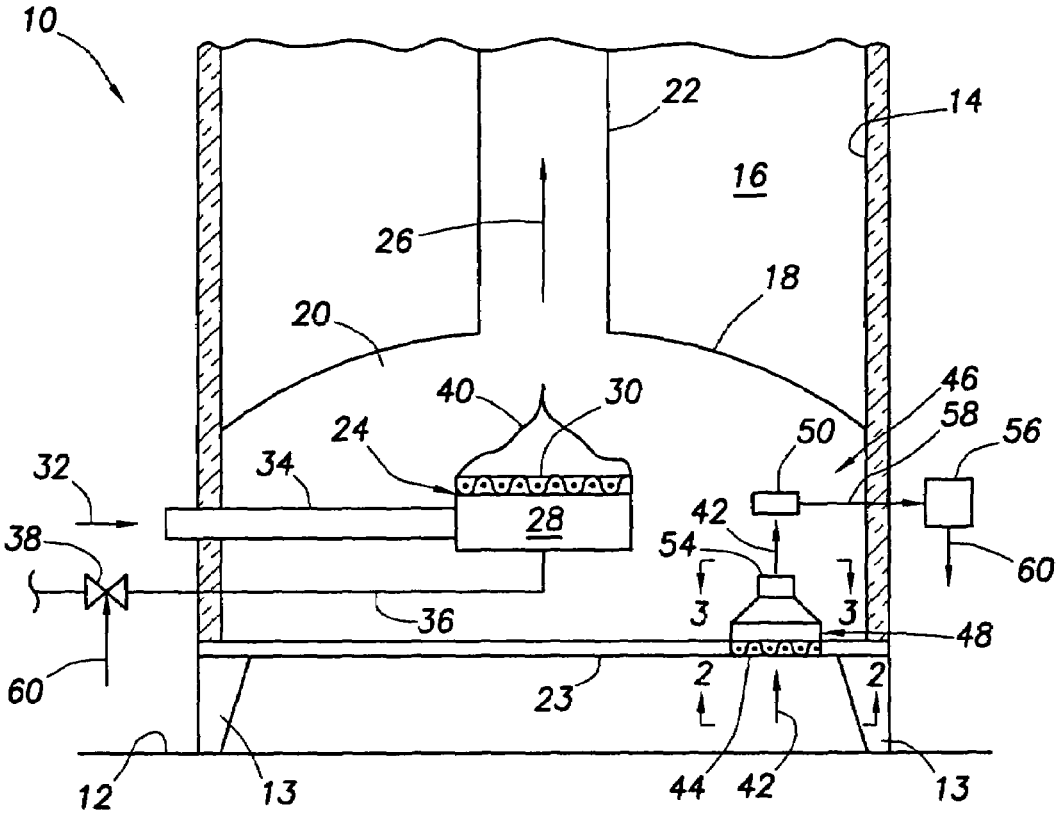
FIG. 1 is a schematic cross-sectional view through a lower end portion of a representative fuel-fired hot water heater incorporating therein a specially designed burner clogging detection and shutdown system embodying principles of the present invention.

DETAILED DESCRIPTION schematically illustrated in FIG. 1 in cross-sectional form is a lower end portion of a fuel-fired heating appliance, representatively a natural draft gas-fired water heater 10, embodying principles of the present invention. While the heating appliance is representatively a water heater, it could alternatively be a different type of fuel-fired heating appliance, such as, for example, a fuel-fired boiler or air heating furnace without departing from principles of the present invention.

Water heater 10 is shown resting on a horizontal support surface such as floor 12, on elevating support legs 13, and includes a cylindrical, vertically extending insulated metal tank 14 in which a quantity of pressurized heated water 16 is stored for on-demand delivery in the usual manner to plumbing fixtures (not shown) such as sinks, showers, dishwashers and the like. The bottom wall of the tank 14 defines the top wall 18 of a combustion chamber 20 that underlies the tank 14. Extending upwardly from the wall 18, through the water 16, is a flue pipe 22 communicating with the interior of the combustion chamber 20. Combustion chamber 20 has a bottom wall 23.

A main gas burner 24, representatively a radiant burner, is disposed within the interior of the combustion chamber 20. Other types of fuel burners could alternatively be utilized without departing from principles of the present invention. Firing of the burner 24 creates hot combustion products 26 that pass upwardly through the flue pipe 22 and transfer combustion heat to the stored water 16.

Radiant burner 24 has a horizontally elongated hollow body 28 with a top perforate flame-holding wall section 30 which is illustratively of a metal wire mesh construction. The interior of the burner body 28 is supplied with primary combustion air 32, via a conduit 34, from outside the combustion chamber 20. The primary combustion air 32 delivered to the burner body 28 is mixed with fuel supplied through a fuel supply pipe 36 having a normally closed gas valve 38 installed therein and being held open in a suitable conventional manner during fuel supply to the burner 24. The fuel and primary combustion air 32 are suitably ignited to form a burner flame 40 on the mesh flame-holding wall section 30 of the burner 24, and thereby create the hot combustion products 26 upwardly traversing the flue 22.

During firing of the burner 24, secondary combustion air 42 from outside the combustion chamber 20 is drawn into the combustion chamber 20 through a cloggable perforate structure in the form of a metal mesh section 44 of the bottom combustion chamber wall 23. Mesh 44 is of a finer mesh size than the coarser burner mesh 30, and is thus more rapidly clogged by particulate matter (such as lint, dirt and/or oil) entrained in the incoming secondary combustion air 42 compared to the rate of clogging of the burner mesh 30 by particulate matter entrained in the incoming primary combustion air 32.

As used herein, the term "primary combustion air" means air which passes through the burner 24 and is combusted with fuel to form the burner flame 40, and the term "secondary combustion air" means air that is externally delivered to the burner 24 to support combustion of the already-formed burner flame 40.

Figure 2:
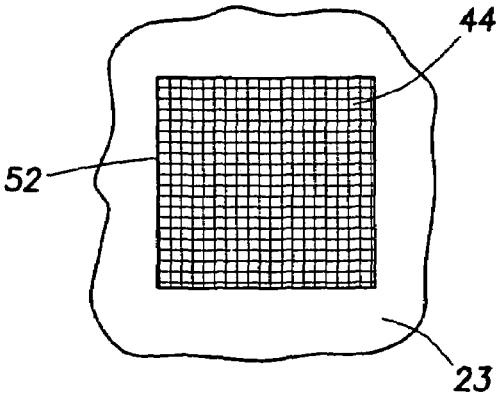
FIG. 2 is an enlarged scale bottom end elevational view of the water heater taken along line 2—2 of FIG. 1.
Figure 3:
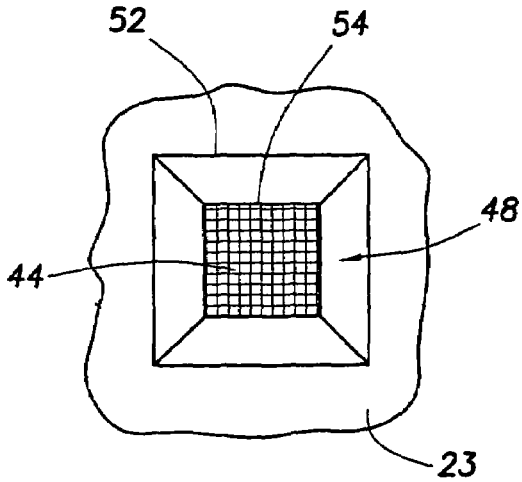
FIG. 3 is an enlarged scale interior elevational view of the water heater taken along line 3—3 of FIG. 1.

The mesh section 44 forms a portion of a unique clogging detection system 46 shown in FIGS. 1–3, embodying principles of the present invention and operative to shut down the water heater 10 prior to a predetermined degree of clogging of the burner flame holding mesh 30. In addition to the mesh 44, the clogging detection system 46 preferably includes an air delivery duct 48, and a temperature sensor 50 disposed within the combustion chamber 20.

Representatively, the temperature sensor 50 may be a suitable thermal release device (TRD), or any other one of a variety of other conventional temperature sensing devices, such as a thermocouple, without departing from principles of the present invention.

Duct 48 has an open inlet end 52 coupled to the mesh section 44, and is preferably of a tapered configuration providing the duct with a substantially smaller area open outlet end 54. During firing of the water heater 10, the secondary combustion air 42 from outside the combustion chamber 20 is drawn upwardly through the mesh section 44, through the interior of the duct 48, and is outwardly discharged through the duct outlet end 54 at a substantially increased velocity relative to its inlet velocity through the mesh 44. Secondary combustion air 42 exiting the duct 48 impinges upon and cools the temperature sensor 50.

As the secondary combustion air inlet mesh 44 begins to clog with particulate matter entering the duct 48 with the incoming secondary combustion air 42, the flow rate and discharge velocity of the secondary combustion air 42 are decreased, thereby reducing its cooling of the temperature sensor 50. When the mesh 44 is substantially completely clogged (at a point in time well before the substantially coarser burner mesh 30 is unacceptably clogged) the temperature of the temperature sensor 50 increases to a predetermined trigger temperature which responsively causes the temperature sensor 50 to output to a controller 56 a shutoff signal 58. In response, the controller 56 outputs a shutoff signal 60 used to terminate burner combustion.

The signal 60 may be used, in a known conventional manner, to terminate further combustion air flow into the combustion chamber 20, or (as schematically depicted in FIG. 1) be transmitted to the gas valve 38 causing it to return to its normally closed position and shut off further gas flow to the burner 24. In this manner, the clogging detection system 46 functions (via its monitoring of the temperature of the temperature sensor 50) as a shutdown system for indirectly monitoring the discharge velocity of the secondary combustion air 42 exiting the duct 48 and responsively terminating operation of the fuel burner 24 when such secondary combustion air discharge velocity decreases to a predetermined magnitude.

While it is preferable that the outlet 54 of the duct 48 be smaller than its inlet 52, to thereby increase the velocity of the secondary combustion air 42 that is discharged from the duct 48 and impinges upon the temperature sensor 50, the outlet 54 could alternatively be essentially the same size as the inlet 52—particularly when the water heater 10 is a forced draft water heater utilizing a draft inducer fan (not shown) to increase the draft through the flue 22. With a sufficient draft through the water heater during firing thereof, in some instances the duct 48 could conceivably be eliminated altogether.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber;

a fuel burner disposed within said combustion chamber and operative to create hot combustion products therein, said fuel burner being progressively cloggable by particulate matter entrained in primary combustion air delivered thereto during firing thereof;

a first air supply structure for supplying primary combustion air to said fuel burner from outside of said combustion chamber without exposing the supplied primary combustion air to the interior of said combustion chamber on its way to said fuel burner;

a second air supply structure for receiving secondary combustion air from outside said combustion chamber and discharging the received secondary combustion air into the interior of said combustion chamber, at a discharge velocity, for flow therethrough to said fuel burner, said second air supply structure being progressively cloggable, at a greater rate than said fuel burner, by particulate matter entrained in the received secondary combustion air in a manner progressively reducing said discharge velocity; and a system for monitoring said discharge velocity and responsively terminating operation of said fuel burner when said discharge velocity decreases to a predetermined magnitude.

2. The fuel-fired heating apparatus of claim 1 wherein:

said fuel-fired heating apparatus is a fuel-fired water heater.

3. The fuel-fired heating apparatus of claim 2 wherein:

said fuel-fired water heater is a gas-fired water heater.

4. The fuel-fired heating apparatus of claim 1 wherein:

said fuel burner is a radiant fuel burner with a cloggable perforate flame-holding outer wall section.

5. The fuel-fired heating apparatus of claim 4 wherein:

said cloggable perforate flame-holding outer wall section is of a metal mesh construction.

6. The fuel-fired heating apparatus of claim 1 wherein:

said second air supply structure includes a cloggable perforate structure disposed on an outer wall of said combustion chamber.

7. The fuel-fired heating apparatus of claim 6 wherein:

said second air supply structure further includes a duct disposed in said combustion chamber and having an open inlet end connected to said cloggable perforate structure, and an open outlet end through which secondary combustion air may be discharged into said combustion chamber at said discharge velocity.

8. The fuel-fired heating apparatus of claim 7 wherein:

said open outlet end has a smaller cross-sectional area than said open inlet end.

9. The fuel-fired heating apparatus of claim 7 wherein:

said system includes a temperature sensor being positioned within said combustion chamber to be impinged upon and cooled, during firing of said fuel burner, by secondary combustion air being discharged from said open outlet end of said duct, said temperature sensor being operative to output a control signal indicative of the temperature of said temperature sensor increasing to a predetermined elevated temperature and being useable to terminate operation of said fuel burner.

10. The fuel-fired heating apparatus of claim 9 wherein:

said temperature sensor is a thermal release device.

11. The fuel-fired heating apparatus of claim 9 wherein:

said temperature sensor is a thermocouple.

12. The fuel-fired heating apparatus of claim 9 wherein:

said fuel-fired heating apparatus further comprises a fuel supply system including a fuel supply pipe connected to said fuel burner and having a fuel valve connected therein, and said system further includes a control structure operative to receive said control signal and responsively cause the closure of said fuel valve.

13. A fuel-fired water heater comprising:

a tank for storing water to be heated;

a combustion chamber in thermal communication with said tank;

a fuel burner operative to create hot combustion products within said combustion chamber, said fuel burner being progressively cloggable by particulate matter entrained in primary combustion air being delivered thereto during firing thereof;

a first air supply structure for supplying primary combustion air to said fuel burner from outside of said combustion chamber without exposing the supplied primary combustion air to the interior of said combustion chamber on its way to said fuel burner;

a second air supply structure for receiving secondary combustion air from outside said combustion chamber and discharging the received secondary combustion air into the interior of said combustion chamber, at a discharge velocity, for flow therethrough to said fuel burner, said second air supply structure being progressively cloggable, at a greater rate than said fuel burner, by particulate matter entrained in the received secondary combustion air in a manner progressively reducing said discharge velocity;

a temperature sensor disposed within the interior of said combustion chamber and positioned to be impinged by secondary combustion air being discharged into said combustion chamber from said second air supply structure; and a system for monitoring the temperature of said temperature sensor and responsively terminating the operation of said fuel burner when said temperature reaches a predetermined magnitude indicative of a predetermined reduction in the cooling of said temperature sensor caused by a reduction in said discharge velocity.

14. The fuel-fired water heater of claim 13 wherein:

said temperature sensor is a thermal release device.

15. The fuel-fired water heater of claim 13 wherein:

said temperature sensor is a thermocouple.

16. The fuel-fired water heater of claim 13 wherein:

said fuel burner is disposed within said combustion chamber; and said first air supply structure includes a primary combustion air supply duct extending into said combustion chamber and operatively connected to said fuel burner.

17. The fuel-fired water heater of claim 13 wherein:

said second air supply structure includes a cloggable perforate structure disposed on an outer wall of said combustion chamber, and further includes a duct disposed in said combustion chamber and having an open inlet end connected to said cloggable perforate structure, and an open outlet end through which secondary combustion air may be discharged into said combustion chamber at said discharge velocity.

18. The fuel-fired water heater of claim 17 wherein:

said open outlet end has a smaller cross-sectional area than said open inlet end.

19. The fuel-fired water heater of claim 17 wherein:

said fuel burner is a radiant burner having a cloggable flame-holding metal mesh section, and said cloggable perforate structure disposed on an outer wall of said combustion chamber is a metal mesh structure of a finer mesh size than said cloggable flame-holding metal mesh section of said radiant burner.

20. The fuel-fired water heater of claim 13 wherein:

said fuel-fired water heater further comprises a fuel supply system including a fuel supply pipe connected to said fuel burner and having a fuel valve connected therein, said temperature sensor is operative to output a control signal indicative of the temperature of said temperature sensor increasing to a predetermined elevated temperature and being useable to terminate operation of said fuel burner, and said system for monitoring further includes a control structure operative to receive said control signal and responsively cause the closure of said fuel valve.

* * * * *

UNITED STATES PATENT AND TRADEMARK OFFICE

CERTIFICATE OF CORRECTION

PATENT NO. : 7,222,591 B2
APPLICATION NO. : 11/374356
DATED : May 29, 2007
INVENTOR(S) : Jacob A. Peart and Hector J. Donastorg It is certified that error appears in the above-identified patent and that said Letters Patent is hereby corrected as shown below:

Column 1, line 46, the word “is” should be deleted.

Column 2, line 62, the word “schematically” should read --Schematically--.

Claim 19, column 6, line 45 “17” should read --13--.

Claim 19, column 6, line 46 “fuel” should read --fuel-fired--.

Claim 20, column 6, line 53 “13” should read --17--.

Signed and Sealed this

Twenty-fifth Day of December, 2007

JON W. DUDAS
*Director of the United States Patent and Trademark Office*